US008530732B2

(12) United States Patent
Suzuki et al.

(10) Patent No.: US 8,530,732 B2
(45) Date of Patent: Sep. 10, 2013

(54) HAMMER DEVICE FOR ELECTRONIC KEYBOARD INSTRUMENT

(71) Applicant: Kabushiki Kaisha Kawai Gakki Seisakusho, Hamamatsu (JP)

(72) Inventors: Akhiro Suzuki, Hamamatsu (JP); Hideyuki Ishida, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 13/631,276

(22) Filed: Sep. 28, 2012

(65) Prior Publication Data

US 2013/0081532 A1 Apr. 4, 2013

(30) Foreign Application Priority Data

Sep. 29, 2011 (JP) ..... 2011-214411
Sep. 30, 2011 (JP) ..... 2011-216190
Sep. 30, 2011 (JP) ..... 2011-217444

(51) Int. Cl.
*G10C 3/18* (2006.01)

(52) U.S. Cl.
USPC ..... 84/243

(58) Field of Classification Search
USPC ..... 84/243, 236, 221, 719–720, 423–433, 84/438
See application file for complete search history.

(56) References Cited

U.S. PATENT DOCUMENTS 3,096,675 A * 7/1963 Graves ..... 84/237
2011/0017049 A1* 1/2011 Shimoda ..... 84/744

FOREIGN PATENT DOCUMENTS

JP 2010-262129 11/2010

* cited by examiner

*Primary Examiner* — Kimberly Lockett
(74) *Attorney, Agent, or Firm* — Christie, Parker & Hale, LLP

(57) ABSTRACT

A hammer device for an electronic keyboard instrument, enabling prevention of grease or the like from adhering to an actuator portion during mounting of the hammer, to thereby enable speedy hammer mounting work and improve the work efficiency. The hammer device includes a hammer support and hammers arranged side by side in a left-right direction and each pivotally supported by the hammer support to pivotally move in accordance with depression of an associated key. When mounting the hammer to the hammer support, before a shaft hole is engaged with a fulcrum shaft portion, left and right protrusions of the hammer are brought into abutment with respective left and right stopper walls provided close to the respective left and right ends of the fulcrum shaft portion, to thereby prevent the actuator portion from being brought into contact with the fulcrum shaft portion.

5 Claims, 8 Drawing Sheets

HAMMER DEVICE FOR ELECTRONIC KEYBOARD INSTRUMENT

CROSS-REFERENCE TO RELATED APPLICATION

This application claims priority to and the benefit of Japanese Patent Application Number 214411/2011, filed on Sep. 29, 2011, Japanese Patent Application Number 216190/2011, filed on Sep. 30, 2011, and Japanese Patent Application Number 217444/2011, filed on Sep. 30, 2011, the entire disclosures of which are incorporated herein by reference.

BACKGROUND OF THE INVENTION

1. Field of the Invention

This invention relates to a hammer device for an electronic keyboard instrument, which is applied to an electronic keyboard instrument, such as an electronic piano, and includes hammers each configured to pivotally move in accordance with key depression of an associated key.

2. Description of the Related Art

Conventionally, as a hammer device of the above-mentioned type, there has been known one proposed by the present assignee e.g. in Japanese Laid-Open Patent Publication (Kokai) No. 2010-262129. This hammer device is applied to a keyboard device for an electronic piano. The hammer device is comprised of an action chassis formed by metal extrusion, and a plurality of hammers pivotally supported by the action chassis and arranged side by side in a left-right direction. The action chassis is comprised of a hammer supporting part having a fulcrum shaft portion extending in the left-right direction, and a switch mounting part provided in an upper portion of the hammer supporting part in a manner extending obliquely forward and upward from the hammer supporting part. A key switch for detecting key depression information on an associated key is mounted to the switch mounting part. The key switch is comprised of a switch board formed by a printed circuit board, and a plurality of switch bodies each formed by a rubber switch and provided on the lower surface of the switch board in association with the respective hammers.

The hammers are provided for respective keys, and each of the hammers is comprised of an arm-like hammer body extending in a front-rear direction and a weight attached to the front end of the hammer body. The hammer body has a rear end thereof formed with a shaft hole having a C shape in side view. The shaft hole is disengageably engaged with the fulcrum shaft portion of the action chassis, whereby the hammer is supported by the action chassis in a vertically pivotable manner. Further, the upper portion of the hammer body immediately forward of the shaft hole is formed with an actuator portion for pressing the switch body of the key switch from below during key depression.

The keyboard device is comprised of a plurality of swingable keys, and the hammers provided for the respective keys and each configured to pivotally move in accordance with key depression of an associated key. Each of the keys is swingably supported by a balance pin erected near the center of the keyboard device in the front-rear direction. Each of the hammers is comprised of the arm-like hammer body extending in the front-rear direction and the weight attached to the front end of the hammer body, as described above. Further, the hammer is pivotally supported by the action chassis via a bearing in the rear end of the hammer, and is placed on the upper surface of the rear end of the associated key via a capstan screw screwed into the hammer from below at a predetermined location forward of the bearing.

Further, in the above-described keyboard device, the ratio between a length from the front end of a key to an associated balance pin (hereinafter referred to as "the key front portion length") and a length from the balance pin to an associated capstan screw via which an associated hammer is in contact with the key (hereinafter referred to as "the key rear portion length") is set to approximately 3:2.

Generally, an electronic piano is demanded to be made compact in the depth dimension, and hence the length of an entire key in the front-rear direction is set to be shorter than that in an acoustic grand piano (hereinafter simply referred to as "the grand piano"). Further, in the above-described keyboard device, the ratio between the key front portion length and the key rear portion length is set to approximately 3:2 as mentioned above, and therefore the key front portion length of the keyboard device is far shorter than that of the grand piano. For this reason, when an electronic piano provided with the above-described keyboard device is played on, the difference in load e.g. between depression of a portion of a key close to the front end thereof and depression of a portion of the key rearwardly remote from the front end is larger than when a grand piano is played on, which makes it impossible to obtain touch feeling sufficiently similar to that provided by the grand piano.

To solve this problem, it has recently been under study to increase the key front portion length of an electronic piano and reduce the key rear portion of the same so as to obtain touch feeling closely similar to that provided by the grand piano without increasing the depth dimension of the electronic piano, i.e. to dispose the balance pin more rearward than in the conventional keyboard device.

Further, as shown in FIG. 11, the hammer, denoted by reference numeral 101, is comprised of an arm-like hammer body 102 extending in the front-rear direction and a weight 103 attached to the front end of the hammer body 102. The hammer body 102 is formed of a synthetic resin, and the weight 103 is formed of a metal, such as iron, having a high specific gravity. The hammer body 102 has a rear end thereof formed with a shaft hole 104. The shaft hole 104 is engaged with a hammer fulcrum (not shown), whereby the hammer 101 is pivotally supported by the hammer fulcrum.

A capstan screw 105 is screwed into the lower surface of the hammer body 102 at a location forward of the shaft hole 104. The capstan screw 105 is held in contact with the rear end of the upper surface of a swingable key (not shown). Therefore, when the key is depressed, the rear portion of the key pivotally moves upward, and the hammer 101 is driven via the capstan screw 105 and pivotally moves upward about the hammer fulcrum. Further, in the hammer 101, the ratio between a distance LG0 from a center CH0 of the hammer fulcrum to a center of gravity GG0 of the weight 103 and a distance LD0 from the center CH0 of the hammer fulcrum to a driving point PD0 via which the capstan screw 105 is in contact with the key is set to approximately 3.7:1.

In general, in the hammer device constructed as above, grease or the like is applied as a lubricant to the entire fulcrum shaft portion of the action chassis so as to ensure smooth pivotal motion of each hammer. When a hammer is dismounted from the action chassis e.g. for maintenance, after the maintenance operation, it is required to mount the hammer to the action chassis. However, when bringing the shaft hole of the hammer into engagement with the fulcrum shaft portion during the operation for mounting the hammer, the actuator portion of the hammer can be brought into contact with the fulcrum shaft portion, and hence in this case, there is a fear that the grease on the fulcrum shaft portion adheres to the actuator portion of the hammer. In such a case, if the hammer is mounted to the action chassis with the grease adhering to the actuator portion, the following problem will occur:

During playing on the electronic piano, a hammer associated with a depressed key pivotally moves upward to press an associated switch body by the actuator portion thereof, and then when the key is released, the hammer pivotally moves downward and returns to its original key-released state. During this process, however, when the actuator portion of the hammer is departing from the switch body being pressed by the actuator portion, the switch body made of rubber is slightly pulled toward the actuator portion by adhesion of the grease adhering to the actuator portion, and consequently a noise is sometimes produced at the moment when the switch body and the actuator portion are separated from each other. This noise impairs performance played on the electronic piano. Of course, it is possible to avoid adhesion of grease to the actuator portion by mounting the hammer to the action chassis while taking care not to bring the actuator portion into contact with the fulcrum shaft portion. In this case, however, when it is required to mount a large number of hammers, the mounting operation takes much time and labor. Thus, the above-described keyboard device leaves room for improvement.

Further, assuming that the conventional hammer device is directly applied to a keyboard device in which each balance pin is positioned more rearward than it conventionally is, the following problem occurs: In a case where the balance pin is positioned close to the front end of an associated hammer, there is a fear that when the hammer having pivotally moved upward in accordance with key depression is returning to its original key-released state while pivotally moving downward, the hammer comes into abutment with the balance pin. In general, a hammer device for an electronic piano is configured such that each hammer can be dismounted from an action chassis that supports the hammers, e.g. for maintenance. In this case, although each key cannot be dismounted from the action chassis within a range of pivotal motion of an associated hammer which is performed in accordance with the motion of key, in a state where the key on which the hammer is placed via the capstan screw is dismounted from the keyboard device, by pivotally moving the hammer below its position in the key-released state, the hammer can be dismounted from the action chassis. However, in the case where the balance pin is positioned close to the front end of the hammer, when attempting to pivotally move the hammer downward lower than its position in the key-released state, the hammer is sometimes brought into abutment with the balance pin as described above, thereby hindering the hammer from being pivotally moved to a position where it can be dismounted. In this case, the hammer cannot be dismounted from the action chassis.

Further, in the conventional hammer, the ratio between the distance LG0 from the center CH0 of the hammer fulcrum to the center of gravity GG0 of the weight 103 and the distance LD0 from the center CH0 of the hammer fulcrum to the driving point PD0 of the capstan screw 105 is set to a relatively small ratio of approximately 3.7:1, as described hereinabove, which means that the distance LG0 is relatively short. On the other hand, the dynamic load (moment of inertia) of the hammer is approximately proportional to the square of the distance LG0. For this reason, even if the weight 103 is made heavier, the dynamic load increases less effectively than could be otherwise expected from the increase in the weight, and hence the dynamic load tends to be rather insufficient. As a consequence, only a dissatisfactory, light touch feeling can be obtained, and therefore the conventional hammer leaves room for improvement in this respect.

SUMMARY OF THE INVENTION

It is a first object of the present invention to provide a hammer device for an electronic keyboard instrument, which makes it possible to prevent grease or the like from adhering to an actuator portion of a hammer during mounting of the hammer, to thereby enable speedy hammer mounting work and improve the work efficiency in the hammer mounting work.

It is a second object of the present invention to provide a hammer device for an electronic keyboard instrument, which makes it possible not only to reliably avoid abutment of a hammer against a balance pin even when the balance pin is erected below the hammer at a location close to the front end of the hammer, but also to ensure execution of dismounting of the hammer.

It is a third object of the present invention to provide a hammer device for an electronic keyboard instrument, which makes it possible to easily obtain sufficient dynamic load while maintaining excellent response of a hammer, to thereby reliably obtain a satisfactory, excellent touch feeling and improve the performance of the electronic keyboard instrument.

To attain the above first object, in a first aspect of the present invention, there is provided a hammer device for an electronic keyboard instrument, including a hammer support, and a plurality of hammers which are supported by the hammer support in a state arranged side by side in a left-right direction and are each configured to pivotally move in accordance with depression of an associated key, wherein the hammer support comprises a plurality of partition walls arranged in the left-right direction in a manner spaced from each other with a predetermined first width therebetween, for partitioning between each adjacent ones of the hammers, a plurality of fulcrum shaft portions each extending between each adjacent ones of the partition walls in the left-right direction and pivotally supporting an associated one of the hammers, and left and right stoppers provided in the vicinity of respective left and right ends of each of the fulcrum shaft portions and arranged in the left-right direction in a manner spaced from each other with a predetermined second width which is smaller than the first width, wherein each hammer is formed to have an arm-like shape extending in the front-rear direction, and comprises an engaging portion formed in a rear end of the hammer and having a lateral width dimension smaller than the second width, for being pivotally and removably engaged with the fulcrum shaft portion, an actuator portion provided forward of the engaging portion and configured to press a key switch for detecting key depression information on an associated key, by pivotal motion of the hammer caused by depression of the associated key, and left and right protruding portions protruding from left and right side surfaces of the hammer, respectively, at respective locations close to the actuator portion, and wherein when mounting the hammer to the hammer support, before the engaging portion is engaged with the fulcrum shaft portion, the left and right protruding portions are brought into abutment with the respective left and right stoppers to thereby prevent the actuator portion from being brought into contact with the fulcrum shaft portion.

With this arrangement, when mounting a hammer to the hammer support, the engaging portion formed in the rear end of the hammer is brought into engagement with an associated fulcrum shaft portion formed between adjacent partition walls of the hammer support. In this case, the left and right stoppers are provided in the vicinity of the respective left and right ends of each of the fulcrum shaft portions of the hammer support in a manner spaced from each other with the second width which is smaller than the first width between the adjacent partition walls, whereas the engaging portion of the hammer has a width dimension smaller than the second width. Therefore, the engaging portion of the hammer is allowed to advance in between the partition walls and between the stoppers, and can be engaged with the fulcrum shaft portion. Further, the left and right protruding portions are formed on the left and right side surfaces of the hammer, respectively, at the respective locations close to the actuator portion for pressing the key switch, and these protruding portions are brought into abutment with the respective left and right stoppers to thereby prevent the actuator portion from being brought into contact with the fulcrum shaft portion. Thus, when mounting the hammer to the hammer support, before the engaging portion of the hammer is engaged with the fulcrum shaft portion, it is possible to prevent the actuator portion from being brought into contact with the fulcrum shaft portion, so that even when grease or the like is applied as a lubricant to the fulcrum shaft portion, adhesion of the grease to the actuator portion can be prevented. This makes it possible to perform hammer mounting work more speedily than when mounting a hammer while taking care to prevent adhesion of the grease to the actuator portion, and thereby improve the work efficiency in the hammer mounting work.

Preferably, a lateral width dimension between ends of the respective left and right protruding portions of each hammer is set to be smaller than the first width and larger than the second width.

With the arrangement of this preferred embodiment, since the lateral width dimension between the ends of the respective left and right protruding portions of each hammer is smaller than the first width between the adjacent partition walls, the actuator portion of the hammer is allowed to advance in between the two partition walls. Further, since the lateral width dimension between the left and right protruding portions of the hammer is larger than the second width between the left and right stoppers, the actuator portion of the hammer is prevented from advancing in between the two stoppers. Thus, by setting the width dimension between the adjacent partition walls of the hammer support, that between the left and right stoppers of the hammer support, and the width dimension between the left and right protruding portions of the hammer, as described above, it is possible to easy realize the same advantageous effects provided by the first aspect of the present invention.

To attain the above second object, in a second aspect of the present invention, there is provided a hammer device for an electronic keyboard instrument, including keys each extending in a front-rear direction and configured to swing about a balance pin erected at a location rearward of a center of the key in the front-rear direction, wherein the electronic keyboard instrument includes hammers each placed on a rear end of an associated key and configured to pivotally move in accordance with depression of the associated key, wherein the hammer comprises a hammer body extending in the front-rear direction and configured to vertically pivotally movable about a fulcrum at a rear end thereof, the hammer body being disposed rearward of the balance pin, and a weight attached to the hammer body, with a front end thereof positioned forward of the balance pin, wherein the weight is configured not to interfere with the balance pin during pivotal motion of the hammer.

With this arrangement, a hammer is placed on the rear end of an associated key configured to swing about the balance pin erected at a location rearward of the center of the key in the front-rear direction, and pivotally moves in accordance with depression of the key. This hammer comprises the hammer body extending in the front-rear direction and configured to be vertically pivotally movable about the fulcrum of the rear end thereof, and a weight attached to the hammer body. The hammer body is disposed rearward of the balance pin, so that the hammer body is prevented from being brought into abutment with the balance pin during pivotal motion of the hammer. On the other hand, the weight has a front end thereof located forward of the balance pin. In other words, the balance pin is disposed below the weight. This weight is configured not to interfere with the balance pin during pivotal motion of the hammer, so that even when the hammer having pivotally moved upward in accordance with key depression is returning to its original position in the key-released state while pivotally moving downward in accordance with key release, the weight is prevented from being brought into abutment with the balance pin.

Further, in a case where the above-described hammer device is configured, similarly to the general hammer device mentioned hereinbefore, such that each hammer can be dismounted by pivotally moving the hammer lower than its position in the key-released state, the hammer is pivotally moved downward, when dismounting the hammer, in a state where an associated key on which the hammer is placed has been removed. The weight of the hammer does not interfere with the balance pin during pivotal motion of the hammer as described above, and therefore dismounting of the hammer cannot be hindered by the balance pin. As described above, according to this aspect of the invention, even when the balance pin is erected below the hammer at a location close to the front end of the same, it is possible not only to positively avoid abutment of the hammer against the balance pin, but also to ensure dismounting of the hammer.

Preferably, the weight is formed by two left and right weight pieces attached to the respective left and right side surfaces of the hammer body, and the two left and right weight pieces are configured to be spaced at least at a location close to the balance pin with a spacing larger than a diameter of a cross section of the balance pin.

With the arrangement of this preferred embodiment, since the two left and right weight pieces attached to the respective left and right side surfaces of the hammer body are configured to be spaced from each other at least at a location close to the balance pin with a spacing larger than the diameter of the cross section of the balance pin, the two weight pieces is prevented from being brought into abutment with the balance pin. Therefore, with the above-described arrangement, it is possible to easily realize a hammer device that provides the same advantageous effects as provided by the second aspect of the present invention.

To attain the above third object, in a third aspect of the present, there is provided a hammer device for an electronic keyboard instrument, including hammers each configured to pivotally move in accordance with depression of an associated key, wherein the hammer comprises a hammer body having an arm-like shape, which is supported by a hammer fulcrum and configured to pivotally move about the hammer fulcrum by being pressed via a driving point by the depressed key, and a weight attached to the hammer body, and wherein a ratio between a distance from the hammer fulcrum to a center of gravity of the weight and a distance from the hammer fulcrum to the driving point is set within a range of 5:1 to 6:1.

In this hammer device for an electronic keyboard instrument, the hammer pivotally moves about the hammer fulcrum by being pressed via the driving point by the depressed key. Further, the ratio between the distance from the hammer fulcrum to the center of gravity of the weight of the hammer and the distance from the hammer fulcrum to the driving point (hereinafter referred to as "the lever ratio") is set within a range of 5:1 to 6:1.

In a case where the lever ratio is smaller than a ratio of 5:1 (i.e. the distance from the hammer fulcrum to the center of gravity of the weight is relatively short), for the reason described hereinbefore, even if the weight is made heavier, the dynamic load of the hammer tends to be rather insufficient, which makes the touch feeling too light. On the other hand, when the lever ratio is larger than a ratio of 6:1 (i.e. the distance from the hammer fulcrum to the center of gravity of the weight is relatively long), a distance over which the center of gravity of the weight moves becomes excessively large, causing degradation of response of the hammer, such as returning. As a consequence, returning of the key becomes slow, which causes degradation of performance of the electronic piano.

Therefore, by setting the lever ratio within a range of 5:1 to 6:1, it is possible to secure sufficient dynamic load while maintaining excellent response of the hammer, to thereby positively obtain a satisfactory, excellent touch feeling and improve the performance of the electronic piano. Further, since it is only required to change the lever ratio, but not required to add any special component part or mechanism, it is possible to obtain the above-mentioned advantageous effects easily at low costs.

The above and other objects, features, and advantages of the present invention will become more apparent from the following detailed description taken in conjunction with the accompanying drawings.

BRIEF DESCRIPTION OF THE DRAWINGS

FIGS. 2A and 2B are perspective views of a hammer support, in which FIG. 2A shows an entire one-octave hammer support, and FIG. 2B shows the hammer support in a partially cut-away state;

FIGS. 3A and 3B are views of the hammer support, in which FIG. 3A is a plan view, and FIG. 3B is a front view;

FIGS. 4A and 4B are views of a hammer, in which FIG. 4A is a plan view, and FIG. 4B is a side view;

FIGS. 6A and 6B are views each showing how protrusions of the hammer are brought into abutment with the stopper walls during mounting of the hammer to the hammer support, in which FIG. 6A shows a state where the protrusions of the hammer are in abutment with the stopper walls from the front side, and FIG. 6B shows a state where the protrusions of the hammer are in abutment with the stopper walls from below;

FIGS. 8A and 8B are views useful in explaining the relationship between a black-key hammer and an associated balance pin, in which FIG. 8A is a plan view, and FIG. 8B is a side view;

FIGS. 9A and 9B are views showing a variation of the black-key hammer and an associated balance pin, in which FIG. 9A is a plan view, and FIG. 9B is a side view;

DETAILED DESCRIPTION OF PREFERRED EMBODIMENTS

Figure 1:
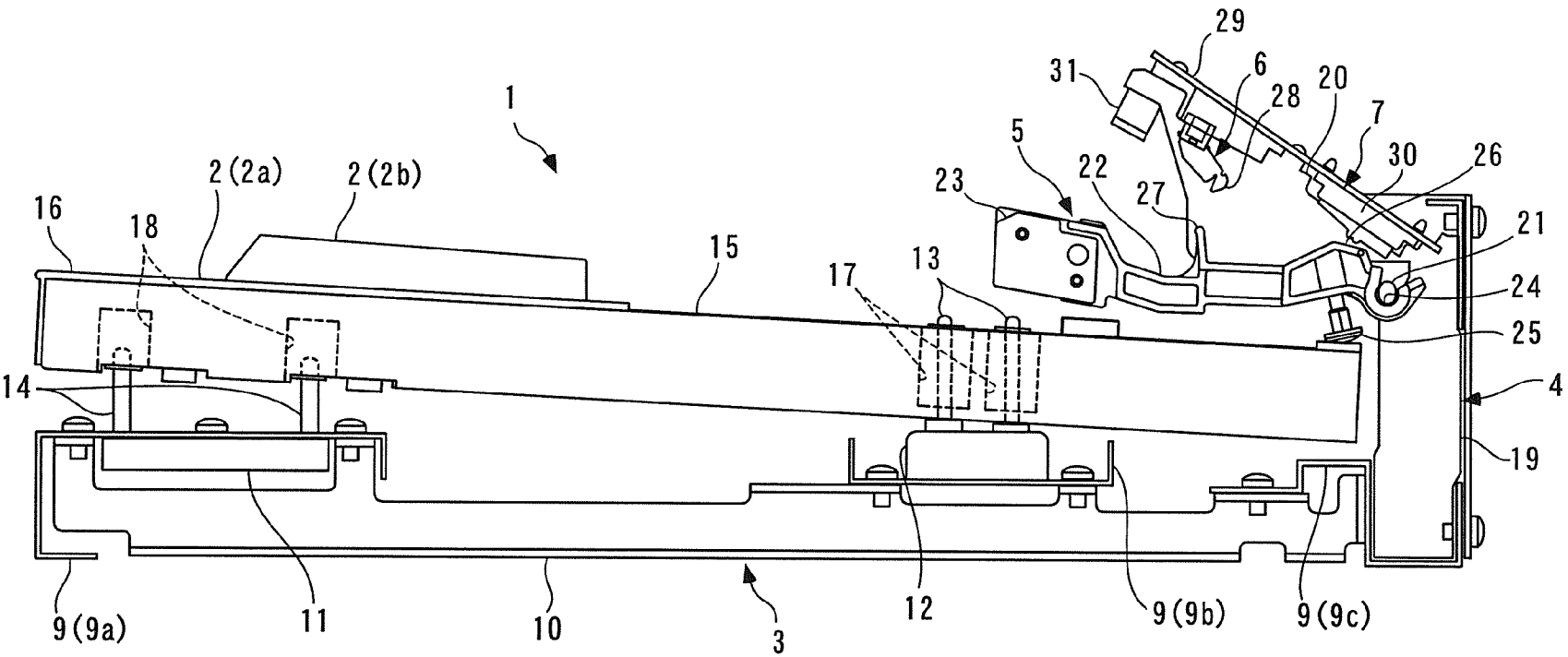
FIG. 1 is a partially cut-away side view of a keyboard device for an electronic piano to which is applied a hammer device according to an embodiment of the present invention.

The present invention will now be described in detail with reference to the drawings showing a preferred embodiment thereof. FIG. 1 shows a keyboard device for an electronic piano to which is applied a hammer device according to the embodiment of the present invention, in a key-released state.

As shown in FIG. 1, the keyboard device 1 includes a plurality of keys 2 (only one of white keys 2*a* and one of black keys 2*b* are shown) arranged side by side in a left-right direction (depth direction as viewed in FIG. 1) of the electronic piano, a keyboard chassis 3 for supporting the keys 2, a hammer support 4 connected to the rear end (right end as viewed in FIG. 1) of the keyboard chassis 3, a plurality of hammers 5 (only one of which is shown) each provided for an associated one of the keys 2, for being pivotally moved in accordance with depression of the key 2, a plurality of let-off members 6 (only one of which is shown) each provided for an associated one of the hammers 5, for adding a let-off feeling to the touch feeling of the associated key 2 when the key 2 is depressed, and a key switch 7 for detecting key depression information on the keys 2.

The keyboard chassis 3 is formed by assembling three support rails 9, i.e. a front rail 9*a*, a central rail 9*b*, and a rear rail 9*c* each extending in the left-right direction, and five reinforcement ribs 10 extending in the front-rear direction, in parallel crosses. The keyboard chassis 3 is secured on a keybed (not shown). Each of the support rails 9 and the ribs 10 is made of iron plate formed into a predetermined shape by press blanking and bending. Each support rail 9 is formed to have a reduced thickness (e.g. 1.0 mm) for reduction of weight, whereas each rib 10 is formed to have an increased thickness (e.g. 1.6 mm) for reinforcement.

A keyframe front 11 is secured to the lower surface of the front rail 9*a*, and a keyframe center 12 is secured to the upper surface of the central rail 9*a*. The keyframe front 11 and the keyframe center 12 each formed as a thick flat plate member of a synthetic resin extend in the left-right direction along the entire front rail 9*a* and the entire central rail 9*b*, respectively. On the keyframe center 12, a large number of balance pins 13 are erected at respective front and rear locations corresponding to the white keys 2*a* and the black keys 2*b*, respectively, in a manner arranged side by side in the left-right direction. Further, on the keyframe front 11, a large number of front pins 14 are erected at respective front and rear locations corresponding to the white keys 2*a* and the black keys 2*b*, respectively, in a manner arranged side by side in the left-right direction.

Each of the keys 2 is comprised of a wooden key body 15 extending in the front-rear direction and having a rectangular cross section, and a key cover 16 made of a synthetic resin and bonded to the top and front surfaces of a front half of the key body 15. A portion of the key body 15 rearward of the center of the key body 15 in the front-rear direction is formed with a balance pin hole 17, and the key 2 is pivotally supported by the balance pins 13 via the balance pin holes 17. Further, a front end of the key body 15 is formed with front pin holes 18, and engagement between the front pin holes 18 and the respective front pins 14 prevents the key 2 from laterally swinging during a pivotal motion thereof.

The hammer support 4 is made of a synthetic resin and formed by connecting a plurality of molded articles, each covering e.g. one octave, to each other. The hammer support 4 extends over the length of all the hammers 5 in the left-right direction, and is fixed to the rear rail 9*c* of the keyboard chassis 3 with screws. The hammer support 4 includes a hammer supporting part 19 erected from near the rear rail 9*c*, and a switch mounting part 20 extending forward and obliquely upward from an upper end of the hammer supporting part 19. The upper end of the hammer supporting part 19 is formed with a horizontal pin-shaped fulcrum shaft portion 21 for supporting the hammers 5.

Each of the hammers 5 is comprised of an arm-like hammer body 22 extending in the front-rear direction, and weight plates 23 (only one of which is shown) attached to left and right side surfaces of the front end of the hammer body 22, respectively. The hammer body 22 is formed by a molded article made of a synthetic resin, while the weight plates 23 are each made of a metal material, such as iron, having a relatively high specific gravity. The hammer body 22 has a rear end thereof formed with an arcuate shaft hole 24 (engaging portion). The shaft hole 24 is engaged with the fulcrum shaft portion 21, whereby the hammer 5 is pivotally supported on the hammer support 4.

Further, a capstan screw 25 is movably screwed into the lower surface of the hammer body 22 at a location slightly forward of the shaft hole 24. The hammer 5 is placed on the rear end of the associated key 2 via the capstan screw 25. A portion of the upper surface of the hammer body 22 between the shaft hole 24 and the capstan screw 25 functions as an actuator portion 26 for causing the key switch 7 to operate when the key 2 is depressed. Further, on a central portion of the upper surface of the hammer body 22 in the front-rear direction, there is formed a plate-like engaging projection 27 that is brought into engagement with an associated let-off member 6 when the key 2 is depressed.

The let-off member 6 is formed by a molded article of a predetermined elastic material (e.g. styrene-based thermoplastic elastomer), and is mounted to the switch mounting part 20 of the hammer support 4. The let-off member 6 extends rearward and downward from the switch mounting part 20, and has an end thereof formed as a head part 28 projecting from a neck part. In a key-released state, the head part 28 is opposed to the engaging projection 27 of the hammer 5.

The key switch 7 is comprised of a switch board 29 formed by a printed circuit board, and switch bodies 30 each formed by a rubber switch and attached to the lower surface of the switch board 29 in association with the keys 2, respectively. The switch board 29 has a rear end thereof inserted in the switch mounting part 20 and a front end and a central part thereof fixed to the switch mounting part 20 with screws. The switch body 30 is mounted to the lower surface of the switch board 29. In a key-released state of each key 2, the associated switch body 30 is opposed to the actuator portion 26 of the associated hammer 5 in a manner slightly spaced therefrom. On the front end of the lower surface of the switch mounting part 20, there is provided a hammer stopper 31 made e.g. of foamed urethane and configured to restrict upward pivotal motion of the hammer 5.

Next, a description will be given of the operation of the keyboard device 1 constructed as above. When depressed from the key-released state shown in FIG. 1, the key 2 pivotally moves about the balance pins 13 in the counterclockwise direction as viewed in FIG. 1, and in accordance with this pivotal motion, the hammer 5 is pushed up via the capstan screw 25 to pivotally move upward (clockwise as viewed in FIG. 1) about the fulcrum shaft portion 21.

During halfway through the pivotal motion of the hammer 5, the engaging projection 27 is brought into engagement with the head part 28 of the let-off member 6 to cause the head part 28 to press the let-off member 6 while compressing the same, whereby a reaction force acting on the hammer 5 from the let-off member 6 is increased. When the hammer 5 further pivotally moves, the engaging projection 27 is disengaged from the head part 28, whereby the reaction force from the let-off member 6 suddenly disappears. The increase and sudden disappearance of the reaction force from the let-off member 6 gives let-off feeling closely similar to that of an acoustic piano.

Then, when the hammer 5 comes into abutment with the hammer stopper 31, the upward pivotal motion of the hammer 5 is stopped. During the upward pivotal motion of the hammer 5, the actuator portion 26 presses the switch body 30 of the key switch 7 to thereby turn on the key switch 7, whereby key depression information on the key 2 corresponding to the amount of pivotal motion of the hammer 5 is detected and output to a tone generation controller (not shown). The tone generation controller controls the tone generation of the electronic piano based on the detected key depression information.

Thereafter, when the key 2 is released, the key 2 performs pivotal motion in a direction reverse to the direction of pivotal motion of the key 2 when depressed, and returns to the key-released state shown in FIG. 1, and accordingly, the hammer 5 also pivotally moves downward to return to the key released state.

Next, a detailed description will be given of the hammer device according to the present invention. FIGS. 2A and 2B and FIGS. 3A and 3B show the hammer support 4 covering one octave. The hammer support 4 is formed by a molded article made of a synthetic resin, as mentioned hereinbefore, and has a plurality of partition walls 51 each partitioning between each adjacent ones of the separating hammers 5 in the left-right direction with a predetermined spacing therebetween. Each partition wall 51 is comprised of a square wall 52 corresponding to the hammer supporting part 19 and formed into a generally rectangular and vertically elongated shape in side view, and a triangular wall 53 corresponding to the switch mounting part 20 and formed into a generally triangular shape in side view and continuous with the upper front end of the square wall 52. In the hammer support 4, all the square walls 52 have front ends and lower ends of respective lower portions thereof formed continuous with each other in the left-right direction, and have rear ends of respective upper portions thereof formed continuous with each other in the left-right direction via a rear wall part 54. On the other hand, all the triangular walls 53 have front half portions of respective upper portions formed continuous with each other in the left-right direction via an upper wall part 55.

A plurality of board latching parts 54*a* are formed on an upper end of a front surface of the rear wall part 54, at respective locations close to the upper ends of the square walls 52, as required, in a manner protruding obliquely upward and frontward from the rear wall part 54. The switch board 29 of the key switch 7 is latched in a state where the rear end thereof is inserted between each of these board latching parts 54*a* and each square wall 52 close thereto.

The upper wall part 55 has a front end of the upper surface thereof formed with a plurality of (two in the present embodiment) screwing parts 56 each having a screw hole 56*a* and protruding upward by a predetermined length, and a rear end of the upper surface thereof formed with a plurality of (three in the present embodiment) board supporting parts 57 each protruding upward by a predetermined length. Each board supporting part 57 is comprised of a pair of protrusions arranged in the left-right direction with a slight spacing therebetween, and a screw hole 57*a* formed between the two protrusions. Further, the upper wall part 55 has a plurality of mounting holes 58 each formed between associated adjacent partition walls 51 and 51 (triangular walls 53 and 53), for use in mounting the associated let-off member 6. Note that an opening 59 is formed in the upper wall part 55 at a location rearward of each mounting hole 58 so as to prevent the engaging projection 27 of the hammer 5 for engagement with the let-off member 6 from abutting on the upper wall part 55 when the hammer 5 pivotally moves upward.

Figure 2A:
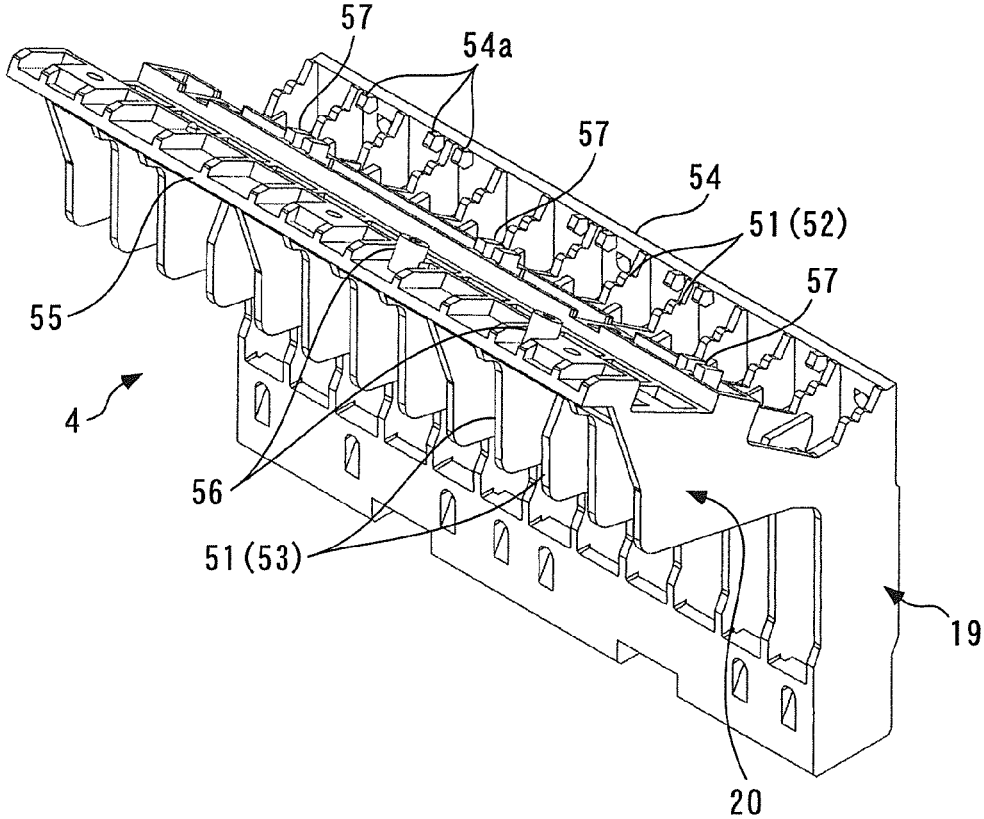
Figure 2B:
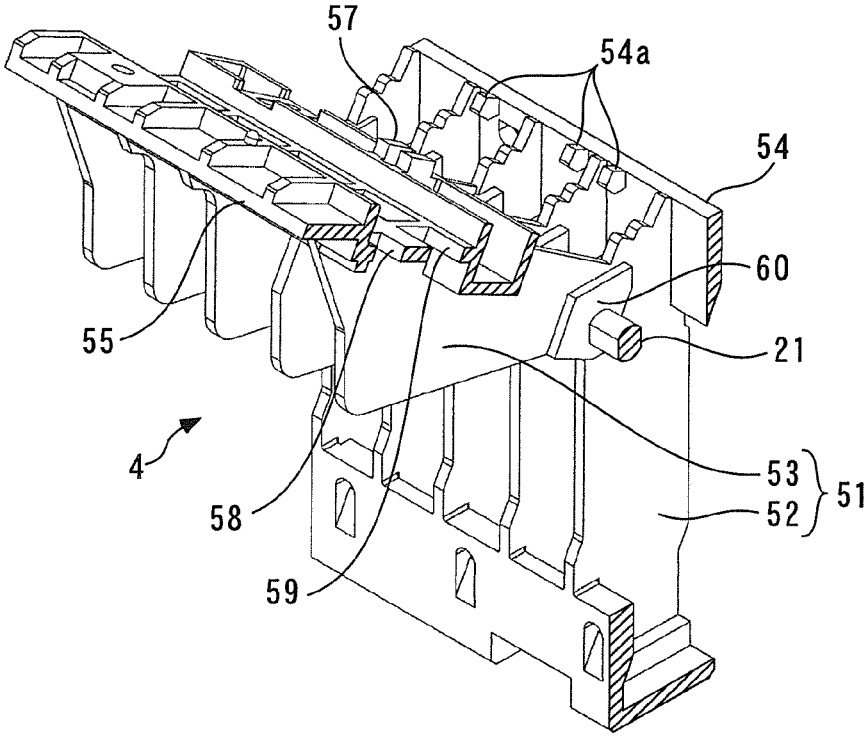
Figure 3A:
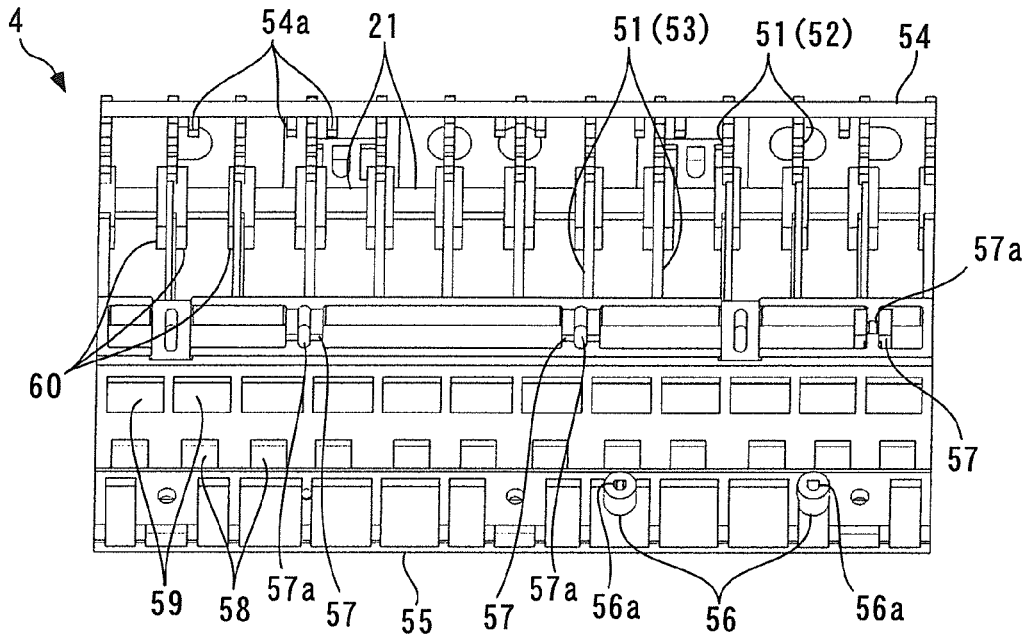
Figure 3B:
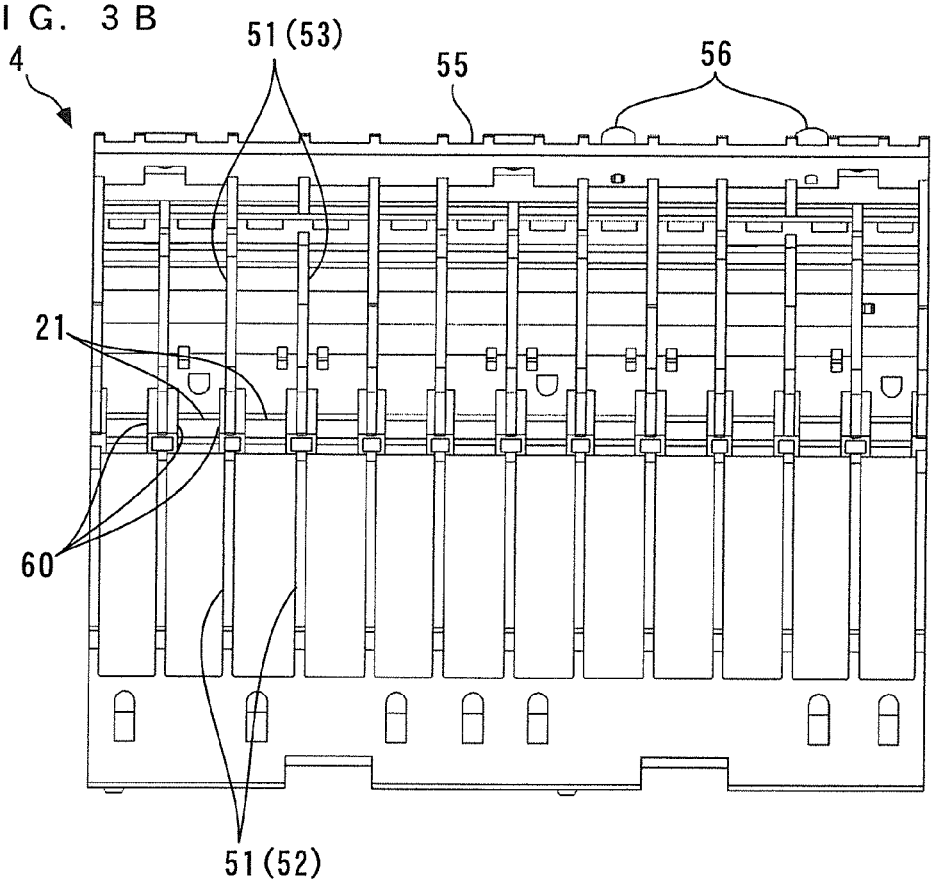

Further, between the adjacent partition walls 51 and 51, the fulcrum shaft portion 21 extending in the left-right direction is provided at a portion where each partition wall 51 and each associated square wall 52 merge with each other. In addition, for each partition wall 51, a stopper wall 60 (stopper) having a predetermined shape larger in cross section than the fulcrum shaft portion 21 and slightly protruding toward the fulcrum shaft portion 21 is provided between an end of the fulcrum shaft portion 21 and the partition wall 51. The hammers 5 are pivotally supported by the respective fulcrum shaft portions 21 as described hereinbefore. Note that grease or the like is applied as a lubricant to each fulcrum shaft portion 21 to ensure smooth pivotal motion of the hammer 5. As shown in FIG. 2B, each fulcrum shaft portion 21 is formed into a vertically elongated elliptical shape in cross section. Specifically, the fulcrum shaft portion 21 is formed such that upper and lower ends thereof each have an arcuate shape and sides thereof have respective straight linear shapes parallel with each other. The hammer 5 is pivotally supported by the fulcrum shaft portion 21, as described hereinbefore, and is removably mounted to the hammer support 4 via the shaft hole 24 engaged with the fulcrum shaft portion 21.

Figure 4A:
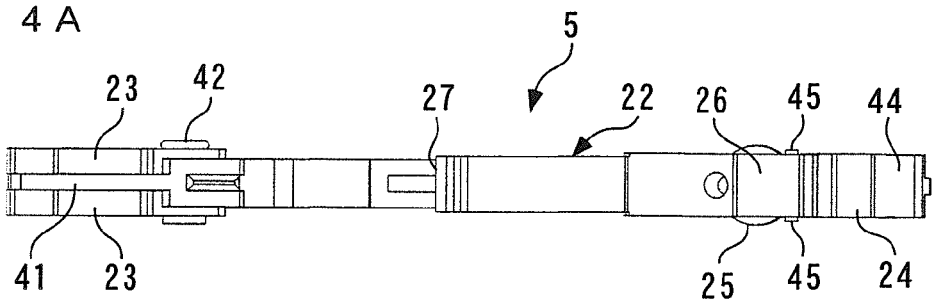
Figure 4B:
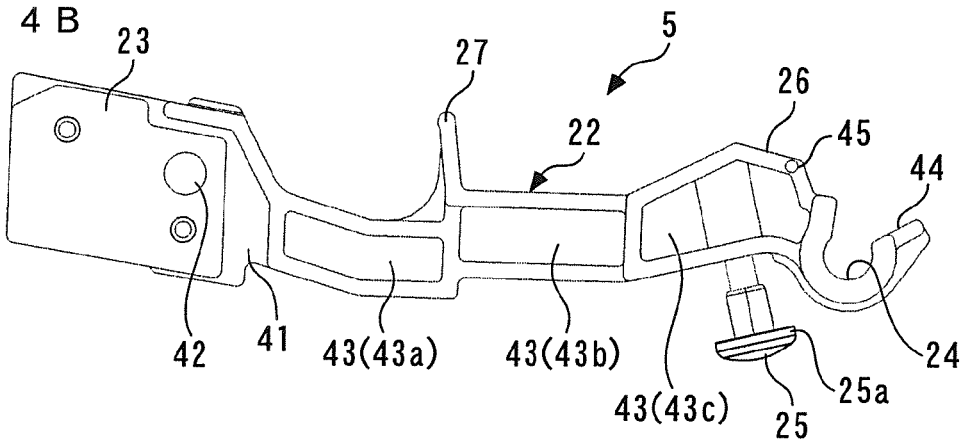

FIGS. 4A and 4B show a hammer 5*a* and the hammer 5*a* is for the white key 2*a*. The hammer body 22 is basically formed symmetrically in the left-right direction as shown in FIG. 4A, and has a predetermined shape in side view as shown in FIG. 4B. The hammer body 22 has a front end formed as a weight mounting part 41 having a relatively thin plate-like shape having a predetermined thickness, and weight plates 23 and 23 each having a plate-like shape are mounted on respective left and right side surfaces of the weight mounting part 41 with rivets 42. Further, in a portion of the hammer body 22 rearward of the weight mounting part 41, there are formed three recessed portions 43, i.e. a front recess 43*a*, a central recess 43*b*, and a rear recess 43*c*, in a manner arranged side by side in the lengthwise direction of the hammer body 22. The front recess 43*a*, the central recess 43*b*, and the rear recess 43*c* are formed in each of the left and right opposite side surfaces of the hammer body 22 in a manner spreading over the substantially whole side surface except a peripheral portion of each recess.

The shaft hole 24 formed in the rear end of the hammer body 22 has an upwardly open C shape in side view, and a guide portion 44 is formed in the open portion of the shaft hole 24 in an outwardly extending manner. In short, the hammer 5 is dismountable from the fulcrum shaft portion 21 via the open portion of the shaft hole 24 of the hammer body 22. Further, the actuator portion 26 of the hammer body 22 is located immediately forward and upward of the shaft hole 24, and is formed to have a predetermined length extending in the front-rear direction.

Further, on the left and right side surfaces of the hammer body 22, there are formed left and right protrusions 45 and 45 (protruding portions) at respective locations close to the rear end of the actuator portion 26. These protrusions 45 and 45 are formed so as to prevent the actuator portion 26 of the hammer 5 from being brought into contact with the fulcrum shaft portion 21 during mounting of the hammer 5 to the hammer support 4.

Figure 5:
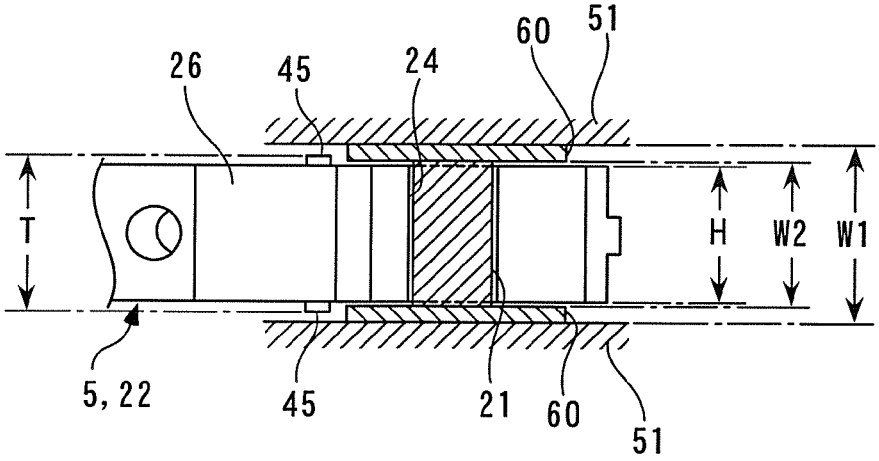
FIG. 5 is a view useful in explaining the relationship in lateral width dimension between partition walls and stopper walls of the hammer support and protrusions of the hammer.

FIG. 5 shows the relationship in lateral width dimension between the partition wall 51 and the stopper wall 60 of the hammer support 4 and the protrusions 45 of the hammer 5. As shown in FIG. 5, a width dimension H of the rear end (shaft hole 24) of the hammer 5 in the left-right direction is set to be smaller than each of a lateral width W1 (first width) between the adjacent partition walls 51 and 51 and a lateral width W2 (second width) between the left and right stopper walls 60 and 60 ($H<W2<W1$). Further, a width dimension T between respective ends of the left and right protrusions 45 and 45 of the hammer 5 is set to be smaller than the lateral width W1 between the partition walls 51 and 51 and larger than the lateral width W2 between the stopper walls 60 and 60 ($W2<T<W1$).

Next, a description will be given of an operation for mounting the hammer 5 to the hammer support 4. In the case of mounting the hammer 5 dismounted from the hammer support 4 e.g. for maintenance of the keyboard device 1 to the hammer support 4 again, first, the shaft hole 24 in the rear end is brought closer to the hammer support 4 from the front side, and is inserted between the adjacent partition walls 51 and 51. Then, the open portion of the shaft hole 24 of the hammer 5 is positioned below the fulcrum shaft portion 21 between the two partition walls 51 and 51. Then, the shaft hole 24 is moved upward while being guided by the guide portion 44 to the fulcrum shaft portion 21, and is brought into engagement with the fulcrum shaft portion 21 (see FIG. 1).

Figure 6A:
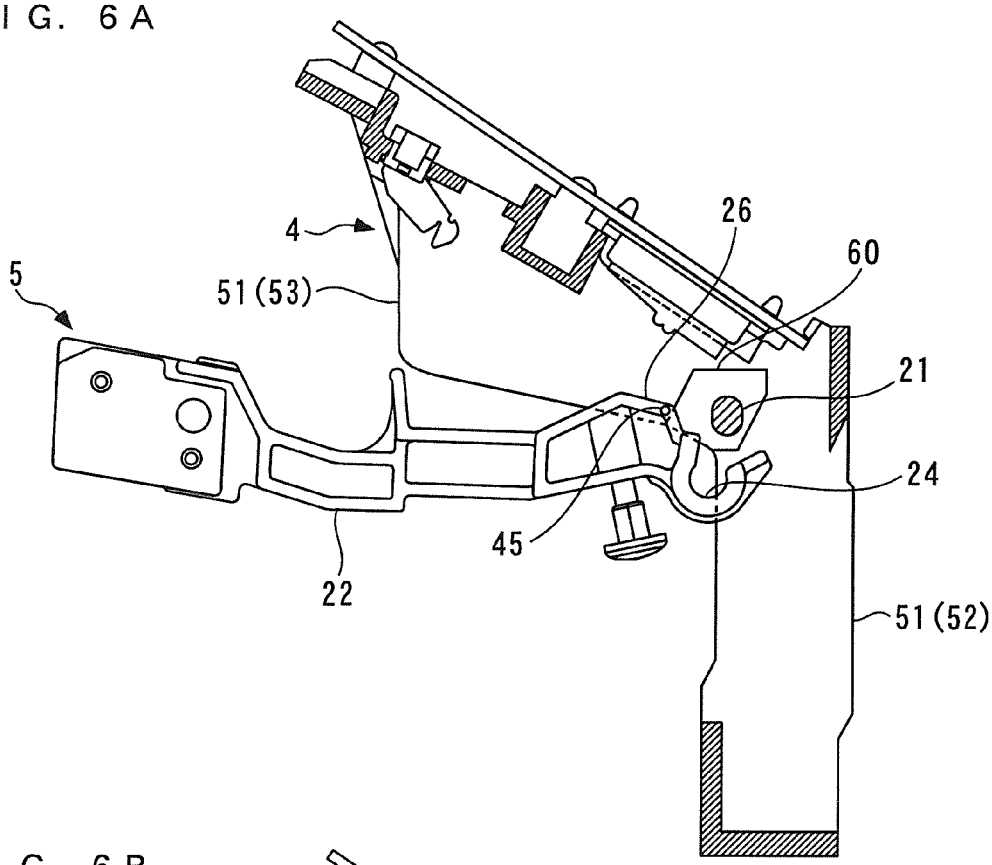

In this case, when the hammer 5 is inserted between the adjacent partition walls 51 and 51 e.g. in a state where the actuator portion 26 of the hammer 5 is positioned at the same height as the fulcrum shaft portion 21 of the hammer support 4, the left and right protrusions 45 and 45 of the hammer 5 are brought into abutment with the respective stopper walls 60 and 60 from the front side, as shown in FIG. 6A. This prevents the hammer 5 including the actuator portion 26 from further moving rearward. Thus, contact of the actuator portion 26 with the fulcrum shaft portion 21 is prevented.

Figure 6B:
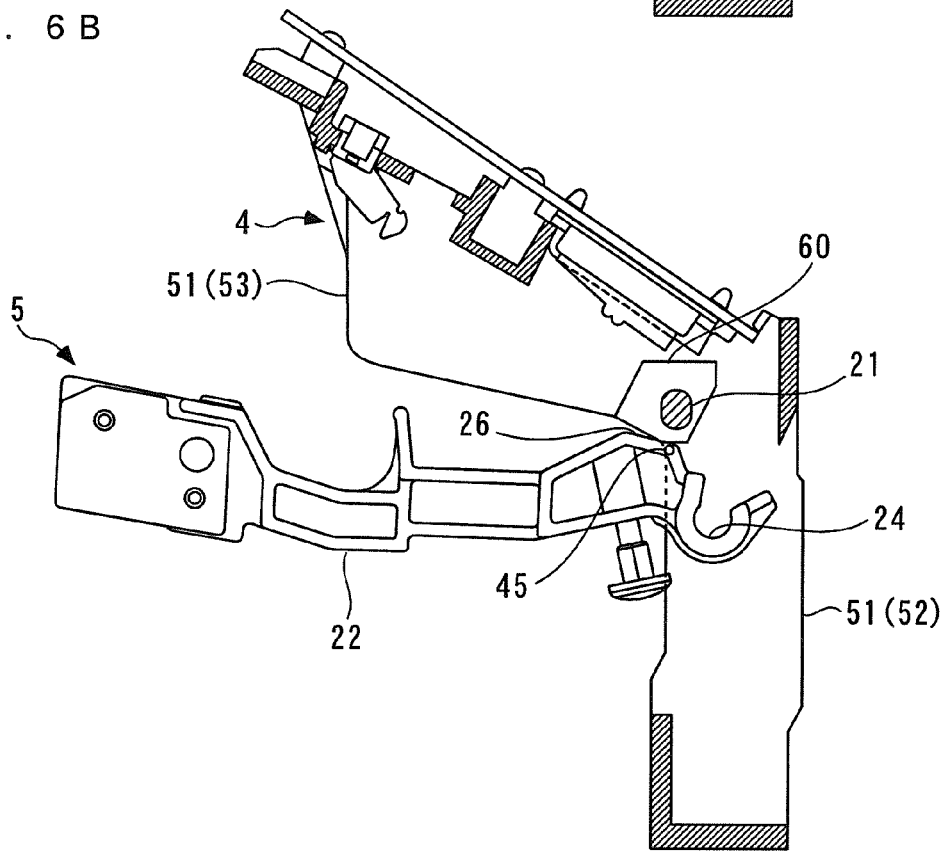

Further, when the shaft hole 24 is moved upward in a state where the actuator portion 26 of the hammer 5 is positioned at a lower height than the fulcrum shaft portion 21 of the hammer support 4 and the shaft hole 24 is positioned rearward of the fulcrum shaft portion 21, the left and right protrusions 45 and 45 of the hammer 5 are brought into abutment with the respective stopper walls 60 and 60 from below, as shown in FIG. 6B. This prevents the hammer 5 including the actuator portion 26 from further moving upward. Thus, contact of the actuator portion 26 with the fulcrum shaft portion 21 is prevented similarly to the above-described case.

With the arrangement of the present embodiment described in detail heretofore, it is possible to prevent the actuator portion 26 of the hammer 5 from being brought into contact with the fulcrum shaft portion 21 of the hammer support 4 when bringing the shaft hole 24 of the hammer 5 into engagement with the fulcrum shaft portion 21 of the hammer support 4 during mounting of the hammer 5 to the hammer support 4, to thereby prevent grease on the fulcrum shaft portion 21 from adhering to the actuator portion 26. This makes it possible to perform hammer mounting work more speedily than when it is required to mount a hammer while taking care to prevent adhesion of the grease to the actuator portion 26, to thereby improve the work efficiency in the hammer mounting work.

Figure 7A:
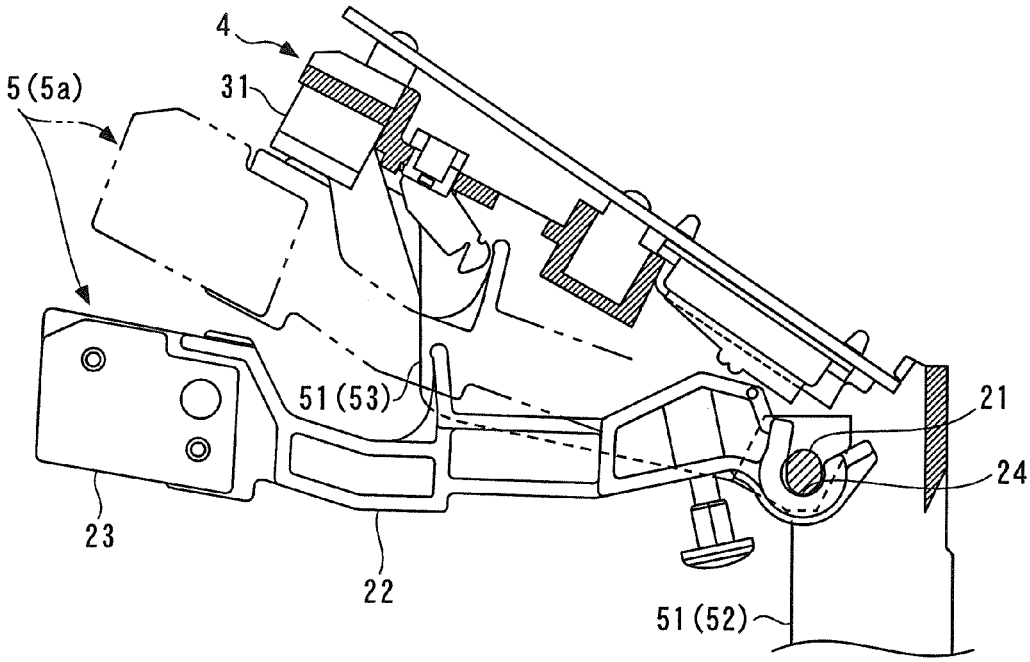
FIG. 7A is a view useful in explaining a range of pivotal motion of the hammer during key depression.

FIG. 7A shows a range of pivotal motion performed by the hammer 5 during key depression. More specifically, during key depression, the hammer 5 pivotally moves between a position in the key-released state, which is indicated by solid lines, and a position indicated by two-dot-chain lines. In this case, the shaft hole 24 of the hammer 5 engaged with the fulcrum shaft portion 21 of the hammer support 4 pivotally moves with its open portion facing more rearward than directly upward. Consequently, the shaft hole 24 engaged with the fulcrum shaft portion 21 having an elliptical shape in cross section is held by the fulcrum shaft portion 21 in a retained state, so that the hammer 5 is prevented from coming off from the fulcrum shaft portion 21.

Figure 7B:
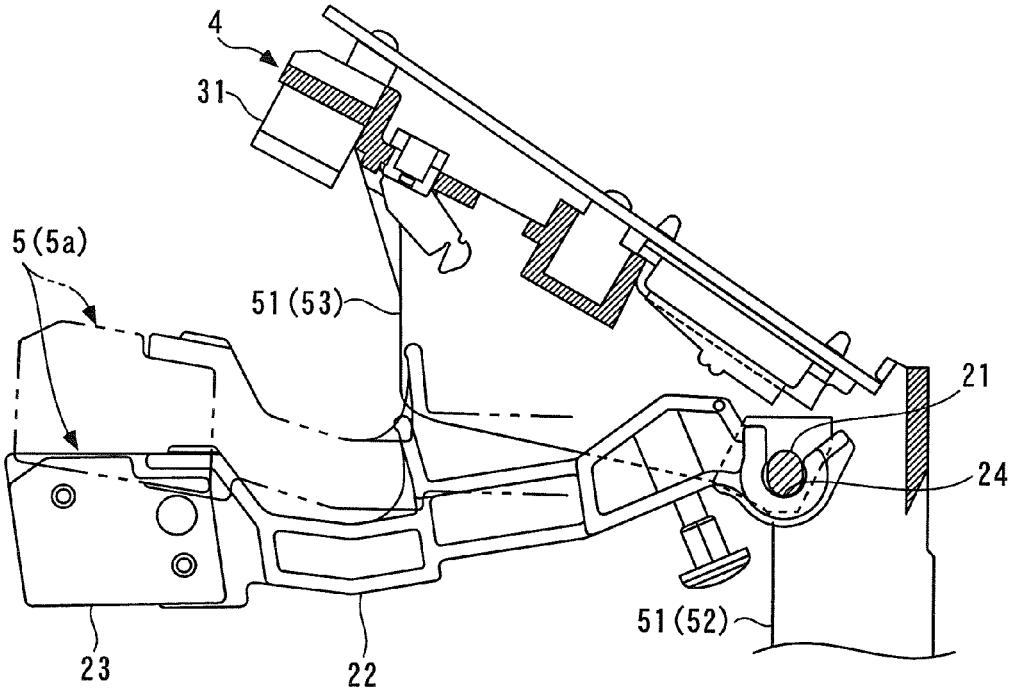
FIG. 7B is a view useful in explaining a movement of the hammer during dismounting of the hammer.

FIG. 7B shows a movement of the hammer 5 in the case of dismounting the hammer 5 from the hammer support 4. Note that the dismounting of the hammer 5 is carried out e.g. for maintenance, in a state where the associated key 2, i.e. the key 2 on which the hammer is placed via the capstan screw 25 is dismounted from the keyboard device 1 in advance. As shown in FIG. 7B, the hammer 5 is pivotally moved downward through a predetermined angle from a position in the key-released state, indicated by two-dot-chain lines, to a dismounting position indicated by solid lines. In this case, the open portion of the shaft hole 24 of the hammer 5 engaged with the fulcrum shaft portion 21 faces directly upward, so that the hammer 5 can be dismounted from the fulcrum shaft portion 21.

As described hereinbefore with reference to FIG. 1, in order to give touch feeling closely similar to that of an acoustic grand piano, the keyboard device 1 has keys each formed to have a key front section longer and a key rear section shorter than in the conventional keyboard device for an electronic piano. Therefore, the balance pin 13 is erected at a location close to the hammer 5. As shown in FIG. 1, the front balance pin 13 associated with the white key 2*a* is erected at a location forward of the hammer 5, whereas the rear balance pin 13 associated with the black key 2*b* is erected in the vicinity of the front end of the hammer 5. In this case, the hammer 5*a* for the white key 2*a* cannot interfere with the balance 13 during pivotal motion, but if the hammer 5*a* is used as a hammer 5 for the black key 2*b*, the hammer 5 can interfere with the balance pin 13. To enable avoidance of this interference with the balance pin 13 during pivotal motion, the hammer 5 for the black key 2*b* is configured as shown in FIGS. 8A and 8B.

Figure 8A:
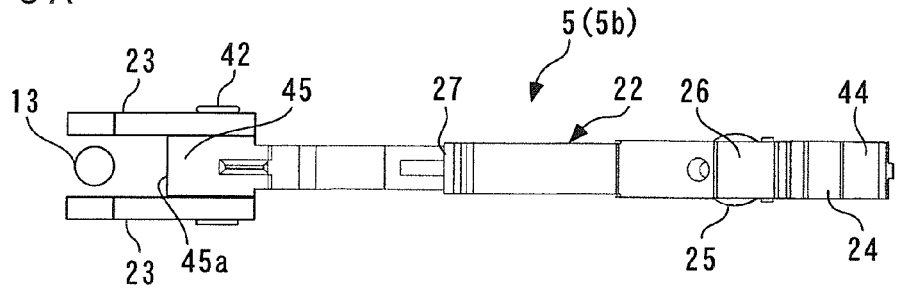
Figure 8B:
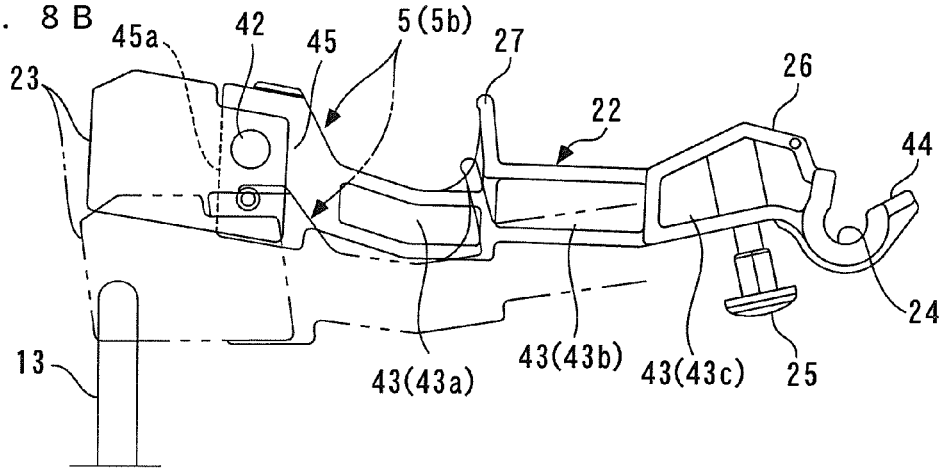

As shown in FIGS. 8A and 8B, a hammer 5*b* for the black key 2*b* is distinguished from the hammer 5*a* for the white key 2*a* only by a weight mounting part 55 to which the weight plates 23 are attached. The weight mounting part 55 is formed to be shorter in length in the front-rear direction and thicker than the weight mounting part 41 of the white-key hammer 5*a*. More specifically, the weight mounting part 55 has a front end 55*a* located rearward of the balance pin 13, and has a larger thickness than the diameter of the cross section of the balance pin 13. Therefore, in the black-key hammer 5*b*, the left and right weight plates 23 and 23 (two left and right weight pieces) attached to the respective left and right side surfaces of the weight mounting part 55 are positioned in a state spaced from each other with a spacing larger than the diameter of the cross section of the balance pin 13. This makes it possible to positively avoid interference of the black-key hammer 5*b* with the balance pin 13, so that even when the hammer 5*b* pivotally moves downward from a position, indicated by solid lines in FIG. 8B, in the key-released state as shown in FIG. 8B, it is possible to prevent the hammer body 22 and the two weight plates 23 and 23 from abutting against the balance pin 13.

With the arrangement of the present embodiment described in detail heretofore, since in the black-key hammer 5*b*, the front end of the hammer body 22, i.e. the front end 55*a* of the weight mounting part 55 is located rearward of the balance pin 13 and the left and right weight plates 23 and 23 are positioned in a state spaced from each other with a spacing larger than the diameter of the cross section of the balance pin 13, the black-key hammer 5*b* is prevented from being brought into abutment with the balance pin 13 during pivotal motion thereof. More specifically, when the black-key hammer 5*b* having pivotally moved upward in accordance with key depression is returning to its original position in the key-released state while pivotally moving downward according to key release, the hammer 5*b* is prevented from being brought into abutment with the balance pin 13. In addition, an operation for dismounting the black-key hammer 5*b* from the hammer support 4 is not hindered by the balance pin 13. As described above, according to the black-key hammer 5*b* of the present embodiment, it is possible not only to positively avoid abutment of the black-key hammer 5*b* against the balance pin 13, but also to ensure dismounting of the black-key hammer 5*b* from the hammer support 4.

Figure 9A:
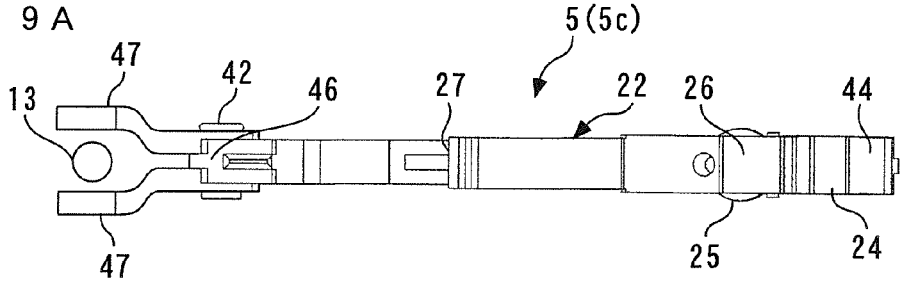
Figure 9B:
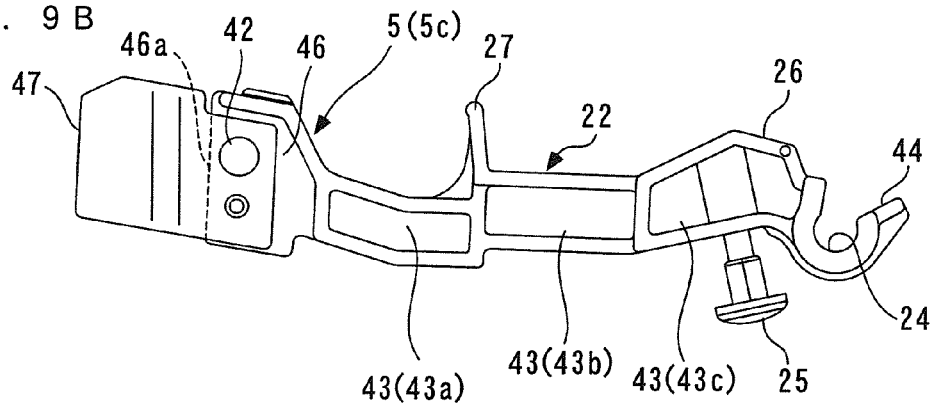

FIGS. 9A and 9B show a black-key hammer 5*c* as a variation of the above-described black-key hammer. As shown in FIGS. 9A and 9B, in the black-key hammer 5*c*, a weight mounting part 46 of the hammer body 22 is formed to be thinner than the weight mounting part 55 of the black-key hammer 5*b* and as thick as the weight mounting part 41 of the white-key hammer 5*a*. Further, left and right weight plates 47 and 47 of the black-key hammer 5*c* are formed such that a spacing therebetween becomes largest in the vicinity of the balance pin 13. This black-key hammer 5*c* provides the same advantageous effects as provided by the above-described black-key hammer 5*b*.

Next, the arrangement of the hammer 5 will be described in more detail. As shown in FIG. 4B, the above-described capstan screw 25 is screwed into the wall portion of the rear recess 43*c* from below. The capstan screw 25 is in abutment with the rear end of the upper surface of the key 2 via a driving point PD (see FIG. 10) of a head portion 25*a* of the capstan screw 25.

Figure 10:
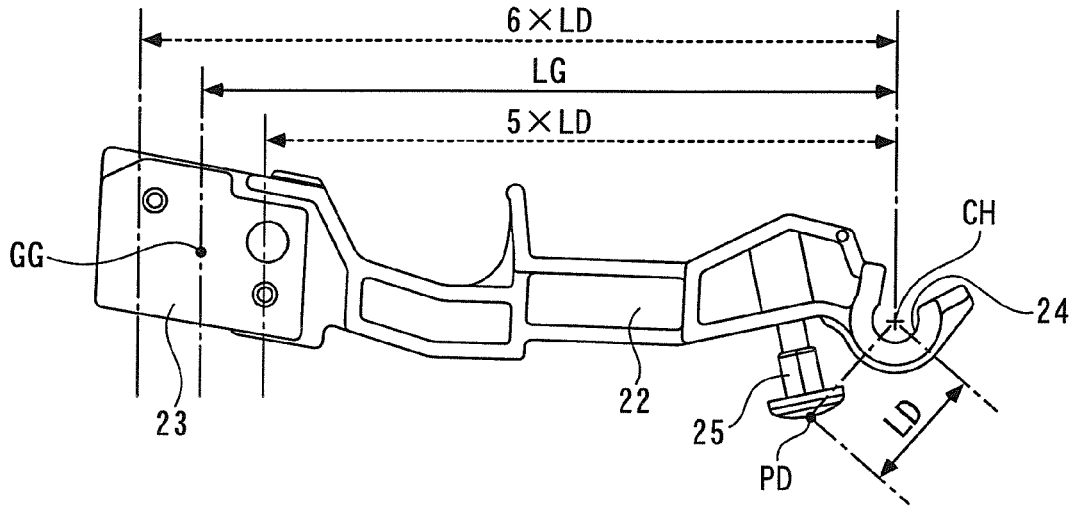
FIG. 10 is a view useful in explaining the relationship between a distance from a hammer fulcrum to the center of gravity of a weight and a distance from the hammer fulcrum to a hammer driving point in the hammer in FIG. 4B.
Figure 11:
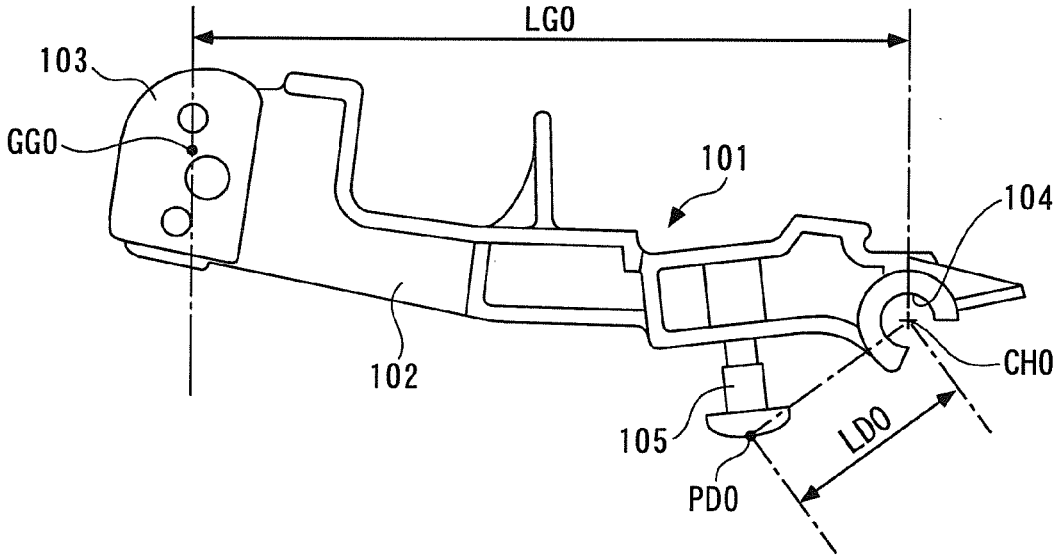
FIG. 11 is a view similar to FIG. 10, which is useful in explaining the relationship in a conventional hammer.

Further, when the distance from a center CH of the fulcrum shaft portion 21 to a center of gravity GG of the weight plate 23 is represented by LG, and the distance from the center CH of the fulcrum shaft portion 21 to the driving point PD where the capstan screw 25 is in abutment with the key 2 is represented by LD as shown in FIG. 10, the hammer 5 has a lever ratio RL (=LG:LD), which is a ratio between the two distances, set e.g. to a ratio of 5.3:1 within a range of 5:1 to 6:1. Note that a lowermost dotted line in FIG. 10 indicates a lower limit distance (=5×LD) corresponding to a lever ratio RL of 5:1, and an uppermost dotted line indicates an upper limit distance (=6×LD) corresponding to a lever ratio RL of 6:1.

According to the present embodiment, since the lever ratio RL is set as above, it is possible to ensure sufficient dynamic load while maintaining excellent response of the hammer 5, and thereby positively obtain a satisfactory excellent touch feeling and improve the performance of the electronic piano.

Further, it is possible to obtain the above-described advantageous effects easily at low costs simply by changing the lever ratio RL, without any need to add a special component part or mechanism.

Note that the present invention is by no means limited to the embodiment described above, but it can be practiced in various forms. Although in the above-described embodiment, the stopper wall 60 corresponding to a stopper of the present invention is formed like a wall between the partition wall 51 and the fulcrum shaft portion 21, this is not limitative, but it is possible to employ various forms insofar as contact of the actuator portion 26 of the hammer 5 with the fulcrum shaft portion 21 of the hammer support 4 can be prevented. For example, the stopper of the present invention may be formed as a stopper extending along the outer peripheral edge of the stopper wall 60 and protruding from the partition wall 51.

Further, although in the above-described embodiment, each of the left and right protrusions 45 and 45 of the hammer 5 is formed as a protrusion circular in cross section, they may be formed as protrusions extending along the actuator portion 26 in the front-rear direction, for example. The detailed construction of the hammer support 4 and that of the hammer 5 in the above-described embodiment are also given by way of example, and they can be modified, as desired, insofar as it does not depart from the subject matter of the present invention. This also applies to the black-key hammer 5*b* described in the embodiment.

Further, it is to be understood that the lever ratio RL is not limited to the ratio set in the above-described embodiment, but it may be set to any ratio within the range of 5:1 to 6:1, whereby the above-described advantageous effects can be similarly obtained.

Although in the above-described embodiment, the hammer 5 is of a type which is disposed above the key 2 swingable about its central portion, and is pushed up for pivotal motion by the key 2 when the key 2 is depressed, this is not limitative, but the present invention is applicable to other types of hammers. For example, the present invention can be applied to a hammer of a type which is disposed below the key 2 that pivotally moves about its rear end, and is pushed down for pivotal motion by the key 2 when the key 2 is depressed.

It is further understood by those skilled in the art that the foregoing is a preferred embodiment of the invention, and that various changes and modifications may be made without departing from the spirit and scope thereof.

What is claimed is:

1. A hammer device for an electronic keyboard instrument, including a hammer support, and a plurality of hammers which are supported by the hammer support in a state arranged side by side in a left-right direction and are each configured to pivotally move in accordance with depression of an associated key, wherein the hammer support comprises:

a plurality of partition walls arranged in the left-right direction in a manner spaced from each other with a predetermined first width therebetween, for partitioning between each adjacent ones of the hammers;

a plurality of fulcrum shaft portions each extending between each adjacent ones of said partition walls in the left-right direction and pivotally supporting an associated one of the hammers; and left and right stoppers provided in the vicinity of respective left and right ends of each of said fulcrum shaft portions and arranged in the left-right direction in a manner spaced from each other with a predetermined second width which is smaller than the first width, wherein each hammer is formed to have an arm-like shape extending in the front-rear direction, and comprises:

an engaging portion formed in a rear end of the hammer and having a lateral width dimension smaller than the second width, for being pivotally and removably engaged with said fulcrum shaft portion;

an actuator portion provided forward of said engaging portion and configured to press a key switch for detecting key depression information on an associated key, by pivotal motion of the hammer caused by depression of the associated key, and left and right protruding portions protruding from left and right side surfaces of the hammer, respectively, at respective locations close to said actuator portion, and wherein when mounting the hammer to the hammer support, before said engaging portion is engaged with said fulcrum shaft portion, said left and right protruding portions are brought into abutment with said respective left and right stoppers to thereby prevent said actuator portion from being brought into contact with said fulcrum shaft portion.

2. The hammer device according to claim 1, wherein a lateral width dimension between ends of said respective left and right protruding portions of each hammer is set to be smaller than the first width and larger than the second width.

3. A hammer device for an electronic keyboard instrument, including keys each extending in a front-rear direction and configured to swing about a balance pin erected at a location rearward of a center of the key in the front-rear direction, wherein the electronic keyboard instrument includes hammers each placed on a rear end of an associated key and configured to pivotally move in accordance with depression of the associated key, wherein the hammer comprises:

a hammer body extending in the front-rear direction and configured to vertically pivotally movable about a fulcrum at a rear end thereof, the hammer body being disposed rearward of the balance pin; and a weight attached to said hammer body, with a front end thereof positioned forward of the balance pin, wherein said weight is configured not to interfere with the balance pin during pivotal motion of the hammer.

4. The hammer device according to claim 3, wherein said weight is formed by two left and right weight pieces attached to the respective left and right side surfaces of said hammer body, and wherein the two left and right weight pieces are configured to be spaced at least at a location close to the balance pin with a spacing larger than a diameter of a cross section of the balance pin.

5. A hammer device for an electronic keyboard instrument, including hammers each configured to pivotally move in accordance with depression of an associated key, wherein the hammer comprises:

a hammer body having an arm-like shape, which is supported by a hammer fulcrum and configured to pivotally move about the hammer fulcrum by being pressed via a driving point by the depressed key, and a weight attached to said hammer body, and wherein a ratio between a distance from the hammer fulcrum to a center of gravity of said weight and a distance from the hammer fulcrum to the driving point is set within a range of 5:1 to 6:1.

* * * * *